US009091263B2

(12) United States Patent
Uozumi et al.

(10) Patent No.: US 9,091,263 B2
(45) Date of Patent: Jul. 28, 2015

(54) INTERNAL GEAR PUMP

(71) Applicant: SUMITOMO ELECTRIC SINTERED ALLOY, LTD., Takahashi-shi, Okayama (JP)

(72) Inventors: Masato Uozumi, Itami (JP); Toshiyuki Kosuge, Itami (JP)

(73) Assignee: SUMITOMO ELECTRIC SINTERED ALLOY, LTD., Okayama (JP)

( * ) Notice: Subject to any disclaimer, the term of this patent is extended or adjusted under 35 U.S.C. 154(b) by 48 days.

(21) Appl. No.: 14/127,892

(22) PCT Filed: Dec. 26, 2012

(86) PCT No.: PCT/JP2012/083541

§ 371 (c)(1),
(2) Date: Dec. 19, 2013

(87) PCT Pub. No.: WO2013/108553

PCT Pub. Date: Jul. 25, 2013

(65) Prior Publication Data

US 2014/0112816 A1 Apr. 24, 2014

(30) Foreign Application Priority Data

Jan. 19, 2012 (JP) ..... 2012-008876

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |
| ***F04C 2/10*** | (2006.01) |
| ***F04C 2/08*** | (2006.01) |

(52) U.S. Cl.

CPC . *F04C 2/10* (2013.01); *F04C 2/084* (2013.01); *F04C 2/102* (2013.01); *F04C 2270/04* (2013.01); *Y10T 29/49242* (2015.01)

(58) Field of Classification Search

CPC ..... F04C 2/102; F04C 2/084; F04C 2/086; F04C 2/10; Y10T 29/49242

USPC ..... 418/150, 166, 171

See application file for complete search history.

(56) References Cited

U.S. PATENT DOCUMENTS

| | | | | |
|---|---|---|---|---|
| 4,504,202 | A * | 3/1985 | Saegusa | 418/150 |
| 4,657,492 | A * | 4/1987 | Saegusa | 418/150 |
| 5,762,484 | A * | 6/1998 | Whitham | 418/150 |

FOREIGN PATENT DOCUMENTS

| | | | |
|---|---|---|---|
| JP | 61223283 | A | 10/1986 |
| JP | 639109 | Y2 | 10/1994 |

(Continued)

OTHER PUBLICATIONS

International Search Report for corresponding Application No. PCT/JP2012/083541, date of mailing Apr. 9, 2013, 2 pages.

*Primary Examiner* — Theresa Trieu

(74) *Attorney, Agent, or Firm* — Ditthavong & Steiner, P.C.

(57) ABSTRACT

In an internal gear pump 9, a diameter of a base circle is set to A mm, a radius of a rolling circle is set to b mm, a diameter of a locus circle is set to C mm, and an amount of eccentricity is set to e mm. A trochoidal curve T is drawn by rolling the rolling circle along the base circle without slipping and by using a locus of a fixed point distant from a center of the rolling circle by e. A tooth profile of an inner rotor 2 having n teeth is formed based on an envelope of a group of the locus circles each having a center on the trochoidal curve T. A pump rotor 1 is formed by combining the inner rotor with an outer rotor having (n+1) teeth. A tooth-profile curve of the inner rotor satisfies the following expression (1). Because K<1 is satisfied, cusps s are not formed at opposite edges of each addendum of the inner rotor 2.

$$K = \frac{C}{6} \cdot \frac{n+2}{n+1} \cdot \sqrt{\frac{n+2}{3n\,(b^2 - e^2)}} < 1 \qquad (1)$$

8 Claims, 7 Drawing Sheets

(56) References Cited

FOREIGN PATENT DOCUMENTS

| | | | |
|---|---|---|---|
| JP | 06280752 | A | 10/1994 |
| JP | 2008157210 | A | 7/2008 |
| JP | 4600844 | B2 | 10/2010 |
| WO | 2010016473 | A1 | 2/2010 |

* cited by examiner

INTERNAL GEAR PUMP

TECHNICAL FIELD

The present invention relates to an internal gear pump equipped with a pump rotor constituted of a combination of an inner rotor whose tooth profile is formed by utilizing a trochoidal curve and an outer rotor having one tooth more than the inner rotor. Specifically, the present invention relates to an internal gear pump that achieves enhanced pump performance by preventing cusps from being formed at the addenda of the inner rotor, and to a method for forming the tooth profile of the inner rotor.

BACKGROUND ART

An internal gear pump is used as, for example, an oil pump for lubricating a vehicle engine, for an automatic transmission (AT), for a continuously variable transmission (CVT), or for supplying diesel fuel.

In a known type of this internal gear pump, the tooth profile of the inner rotor is formed by utilizing a trochoidal curve. As shown in FIG. 8, a diameter A of a base circle, a diameter B of a rolling circle, an amount e of eccentricity, and a diameter C of a locus circle are first set. Then, the rolling circle rolls along the base circle without slipping, and a trochoidal curve T drawn by a point distant from the center of the rolling circle (by the amount e of eccentricity) is obtained. An envelope of a group of circular arcs obtained when a center $C_0$ of the locus circle C is moved along the trochoidal curve T serves as an inner-rotor curve (tooth profile) TC (see FIG. 2 in Patent Literature 1).

An outer rotor used has one tooth more than the inner rotor 2 (the number of teeth of the inner rotor: n, and the number of teeth of the outer rotor: n+1). The tooth profile of the outer rotor is formed based on a method that uses a locus of a group of tooth-profile curves of the inner rotor 2 obtained based on the above-described method, or is formed based on another known method. For example, the former method that uses a locus of a group of tooth-profile curves of the inner rotor involves revolving the center of the inner rotor by one lap along a circle centered on the center of the outer rotor and having a diameter of (2e+t) (e denoting the amount of eccentricity between the inner rotor 2 and the outer rotor 3 and t denoting a tip clearance between the inner rotor 2 and the outer rotor 3 at a theoretical eccentric position), and rotating the inner rotor 2 (1/n) times during the revolution. As the result of the revolution and the rotation of the inner rotor 2, an envelope of a group of inner-rotor tooth-profile curves obtained when the inner rotor 2 rotates n times is drawn, and the envelope serves as the tooth profile of the outer rotor 3 (see FIGS. 3 to 5 in Patent Literature 1, and paragraph [0044] and FIG. 9 in Patent Literature 2).

A pump rotor is formed by combining the inner rotor 2 and the outer rotor 3 manufactured in this manner and disposing these rotors eccentrically relative to each other. This pump rotor is accommodated within a rotor chamber of a housing having an intake port and a discharge port, whereby an internal gear pump is formed (see FIG. 1 in the present application, and paragraph [0048] and FIG. 10 in Patent Literature 2).

In the inner rotor 2 whose tooth profile is formed by utilizing the trochoidal curve, loops R (FIG. 9(*a*)) may form at opposite edges of each addendum 2*a* or cusps s (FIG. 9(*b*)) may form at the opposite edges of the addendum, depending on the selection such as the diameter A of the base circle. A tooth-profile shape having the aforementioned loops R is not realizable in actuality, and since it is impossible that such loops R be formed in a tooth profile, they become cusps s formed at the opposite edges of the addendum.

When a tooth profile having the cusps s at the opposite edges of each addendum is used for a pump, contact stress (i.e., Hertz stress) at the cusps (edges) s increases and causes abrasion or yielding in these areas, thus leading to a reduction in pump performance as well as an increase in vibration and noise.

CITATION LIST

Patent Literature

PTL 1: Japanese Examined Utility Model Registration Application Publication No. 6-39109

PTL 2: Japanese Patent No. 4600844

SUMMARY OF INVENTION

Technical Problem

In the related art, when the cusps s are formed, a method of correcting the cusps s by using an arc-curved surface (i.e., removing the cusps s by forming an arc-curved surface) is employed. However, the correction based on an arc-curved surface leads to an expansion of a tooth gap between the inner rotor 2 and the outer rotor 3, resulting in reduced pump performance (such as volume efficiency).

Furthermore, (1) the size of the rotors and (2) the minimum curvature of the inner rotor 2 and the minimum curvature of the outer rotor fluctuate depending on the diameter C of the locus circle. The fluctuations in (1) may lead to reduced mechanical efficiency of the rotors, and the fluctuations in (2) may lead to an increase in Hertz stress.

Based on experience, a mechanical efficiency of 50% or higher and a Hertz-stress safety factor ((material contact fatigue limit)/(Hertz stress)) of 1.5 or higher are required when the two rotors 2 and 3 mesh with each other, and a product thereof (i.e., (mechanical efficiency)×(Hertz-stress safety factor)) needs to be 75% or higher.

In order to solve the aforementioned problem, a first object of the present invention is to prevent the cusps s from being formed at the opposite edges of each addendum 2*a* of the tooth profile of the inner rotor 2. A second object is to suppress a reduction in mechanical efficiency and an increase in Hertz stress in the tooth profile of the inner rotor 2 having no cusps s.

Solution to Problem

FIGS. 6(*a*), 6(*b*), and 6(*c*) illustrate an envelope TC of a circle C obtained when the center of the circle C is moved along a locus line T constituted of two lines connected by a circular arc having a radius r. As shown in FIG. 6(*a*), when a radius c of the circle C is smaller than the radius r of the circular arc of the locus line T (c<r), an envelope TC that is smooth at the upper and lower sides of the drawing relative to the locus line T can be drawn. On the other hand, as shown in FIG. 6(*c*), when the radius c of the circle C is larger than the radius r of the circular arc of the locus line T (c>r), the envelope TC at the upper side of the drawing relative to the locus line T is smooth, whereas the envelope TC at the lower side of the drawing has a crossing loop R. When the radius c of the circle C and the radius r of the circular arc of the locus line T are equal to each other (c=r), as shown in FIG. 6(*b*), the envelope TC at the lower side of the drawing has a cusp s.

In the case where the tooth profile of the inner rotor is formed by utilizing a trochoidal curve, an envelope at the inner side of a group of circular arcs obtained by moving the center $C_0$ of the locus circle C along the trochoidal curve T serves as the inner-rotor curve (tooth profile) TC, as shown in FIG. 8. In a case where there are sections where a curvature radius ρ of the trochoidal curve T is locally smaller than the radius (C/2) of the locus circle C ($\rho_{min}<(C/2)$), the envelope TC of the group of circular arcs of the locus circle C crosses over at each of these sections, resulting in formation of loops R in the inner-rotor curve (tooth profile) TC (FIG. 9(*a*)). If there are sections where the curvature radius ρ and the radius of the locus circle C are equal to each other, cusps s are formed without any crossovers (FIG. 9(*b*)).

Accordingly, in the present invention, the radius (C/2) of the locus circle C is constantly set to be smaller than the curvature radius ρ of the trochoidal curve T. In other words, the radius (C/2) of the locus circle C is smaller than a minimum curvature radius $\rho_{min}$ of the trochoidal curve T ($C/2<\rho_{min}$).

Next, as shown in FIGS. 7(*a*) and 7(*b*), the following expression is satisfied:

$$\mathrm{COS}(\pi/2-\theta)=\sin\theta=(x^2+b^2-e^2)/2bx$$

where n denotes the number of teeth of the inner rotor 2, b denotes the radius of the rolling circle B (=B/2), C denotes the diameter of the locus circle, and e denotes the amount of eccentricity.

The curvature radius ρ is expressed as follows based on Euler-Savary's formula:

$$(1/x+1/(\rho-x))\sin\theta=1/a+1/b.$$

Assuming that (1/a+1/b)=γ, $$\rho=x+1/(\gamma/\sin\theta-1/x).$$

By substituting the aforementioned sine into this expression of ρ, assuming that $\alpha=b^2-e^2$ and $\rho=2b\gamma-1$, $$\rho=x+(x^3+\alpha x)/(\beta x^2-\alpha).$$

Furthermore, by differentiating ρ with respect to x, $$d\rho/dx=1+((3x^2+\alpha)(\beta x^2-\alpha)-(x^3+\alpha x)(2\beta x))/(\beta x^2-\alpha)^2=((\beta x^2-\alpha)^2+(3x^2+\alpha)(\beta x^2-\alpha)-(x^3+\alpha x)(2\beta x)))/(\beta x^2-\alpha)^2,$$ and the numerator thereof is $(\beta+1)x^2(\beta x^2-3\alpha)$.

Based on $e\le X\le 2b$ and $\beta+1=2b\gamma\neq 0$, x that satisfies $d\rho/dx=0$ is as follows:

$$x=\sqrt{3\alpha/\beta}\,(x>0).$$

Therefore, when $$x=\sqrt{3\alpha/\beta},$$

the curvature radius ρ is at minimum (minimum curvature radius $\rho_{min}$) so that $$\rho_{min}=3\cdot\sqrt{\frac{3(b^2-e^2)}{2b\gamma-1}}\cdot\frac{1+\beta}{2\beta}.$$

Based on $\alpha=b^2-e^2$, $\beta=2b\gamma-1$, and a/b=n, the following is obtained:

$$\rho_{min}=3\cdot\frac{n+1}{n+2}\cdot\sqrt{\frac{3n(b^2-e^2)}{n+2}}.$$

Assuming that the minimum curvature radius $\rho_{min}$ is larger than the radius of the locus circle ($\rho_{min}>C/2$), the following is obtained:

$$\rho_{min}=3\cdot\frac{n+1}{n+2}\cdot\sqrt{\frac{3n(b^2-e^2)}{n+2}}>C/2,\quad \frac{C}{6}\cdot\frac{n+2}{n+1}\cdot\sqrt{\frac{n+2}{3n(b^2-e^2)}}<1$$

With the following expression:

$$\frac{C}{6}\cdot\frac{n+2}{n+1}\cdot\sqrt{\frac{n+2}{3n(b^2-e^2)}}=C/2\rho_{min}=K$$

and K<1 being satisfied, the radius (C/2) of the locus circle C is constantly made smaller than the curvature radius ρ of the trochoidal curve T in FIG. 8, so that cusps s are prevented from being formed at the opposite edges of each addendum 2*a* in the tooth profile of the inner rotor 2, whereby the aforementioned first object is achieved.

Next, in order to achieve a product (i.e., (mechanical efficiency)×(Hertz-stress safety factor)) of 75% or higher, as mentioned above, the value of K is set to $0.2\le K\le 0.97$ from the following experimental result. If $K1=2\rho_{min}-C$, $0.3\le K1\le 9.8$ is satisfied.

Furthermore, assuming that $$K2=\frac{K1}{\sqrt{B^2+e^2}}\,(B=A/n),$$

$0.06\le K2\le 1.8$ is satisfied.

In order to obtain a mechanical efficiency of 50% or higher and a Hertz-stress safety factor of 1.5 times or more, it is desirable that $0.7\le K\le 0.96$, $0.5\le K1\le 2$, and $0.1\le K2\le 0.7$ be satisfied.

By obtaining a tooth profile that satisfies these conditions, the aforementioned second object is achieved.

In this case, K denotes a "ratio", K1 denotes an "amount", and K2 expresses K1 in ratio.

Advantageous Effects of Invention

The present invention has the above-described configuration so as to prevent formation of loops R or cusps s at the opposite edges of each addendum of a tooth profile formed by utilizing a trochoidal curve, as well as suppressing a reduction in mechanical efficiency and an increase in Hertz stress.

BRIEF DESCRIPTION OF DRAWINGS

FIG. 6(*b*) illustrates an envelope of the circle C obtained when the center of the circle C moves along the locus line T, and shows a case where r is equal to c.

FIG. 6(*c*) illustrates an envelope of the circle C obtained when the center of the circle C moves along the locus line T, and shows a case where r is larger than c.

FIG. 7(*b*) illustrates how the minimum curvature radius $\rho_{min}$ of the trochoidal curve T is calculated.

FIG. 9(*b*) is an enlarged view illustrating the tooth-profile shape of the inner rotor in the related art.

DESCRIPTION OF EMBODIMENTS

Figure 1:
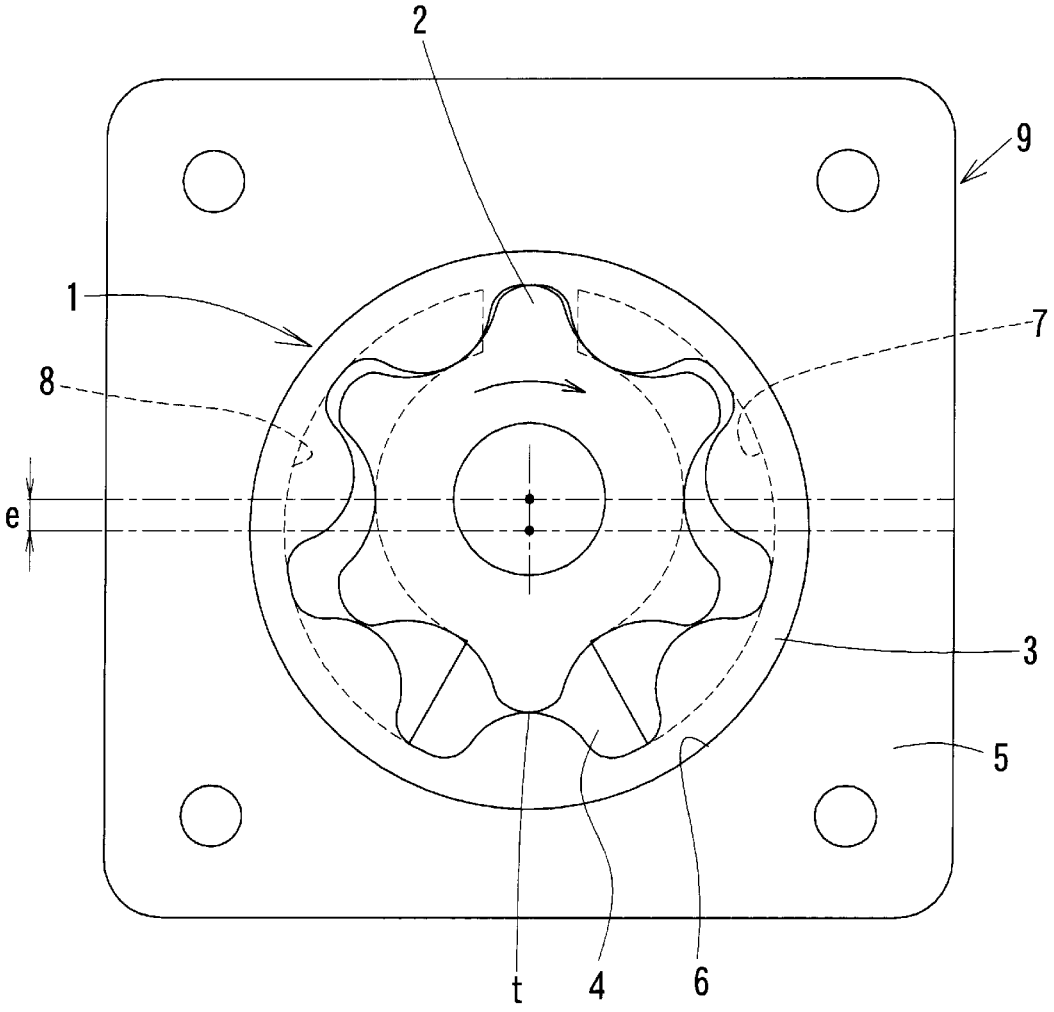
FIG. 1 is an end-surface diagram of an internal gear pump according to an embodiment of the present invention, showing a state where a cover is removed from a housing.
Figure 2:
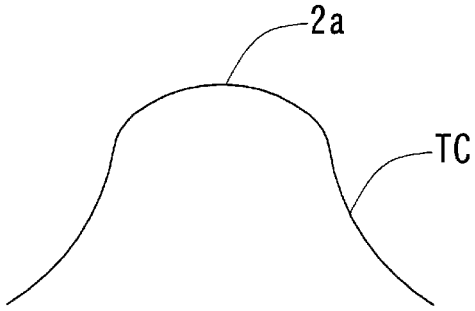
FIG. 2 is an enlarged view of a tooth of an inner rotor according to the embodiment.
Figure 8:
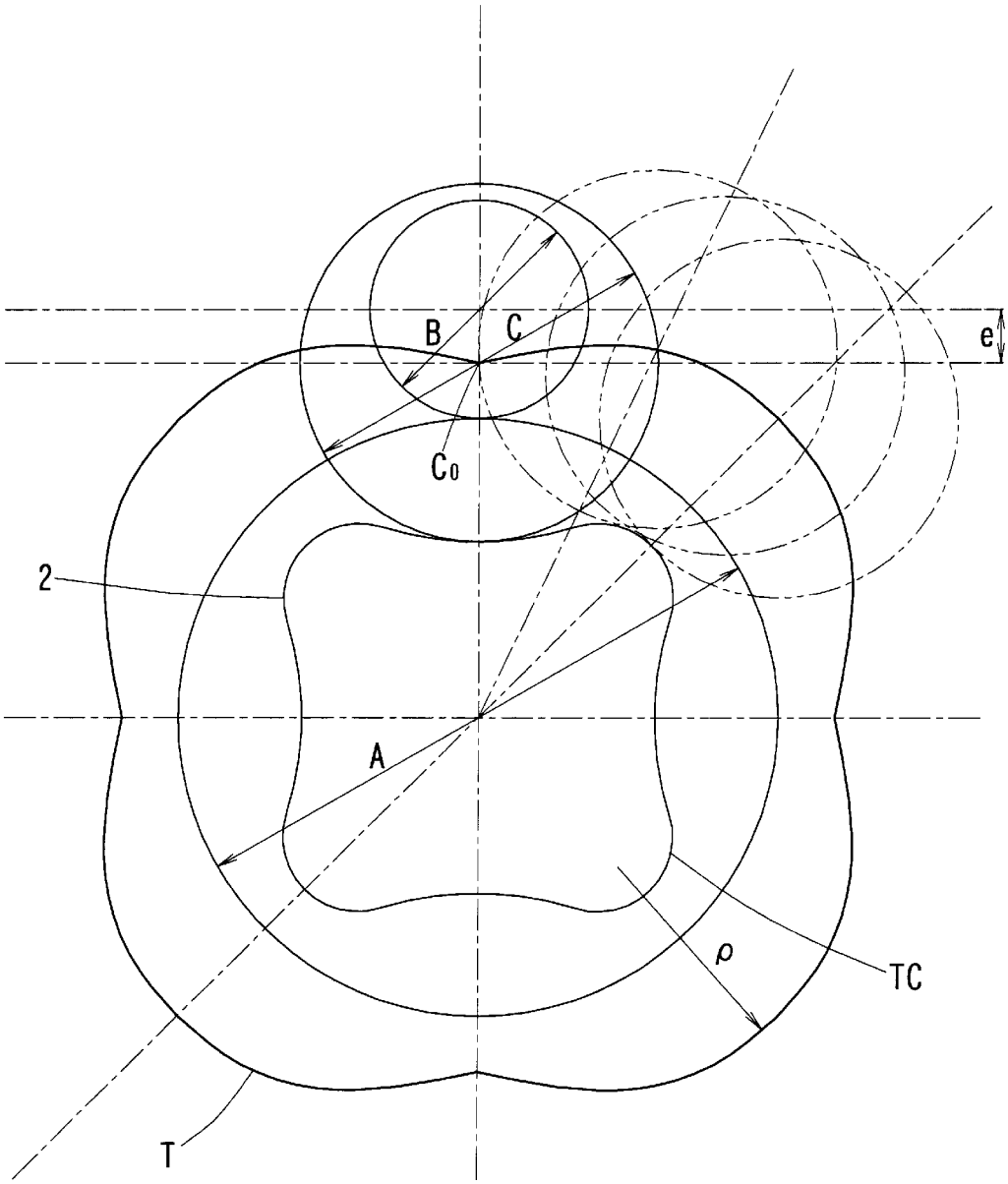
FIG. 8 illustrates an inner rotor design using a trochoidal curve.
Figure 9:
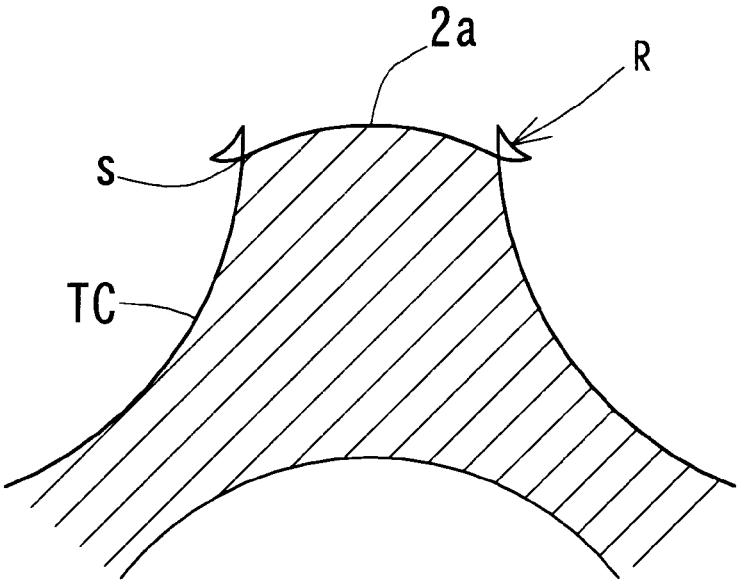
FIG. 9(*a*) is an enlarged view illustrating a tooth-profile shape of an inner rotor in the related art.
Figure 9:
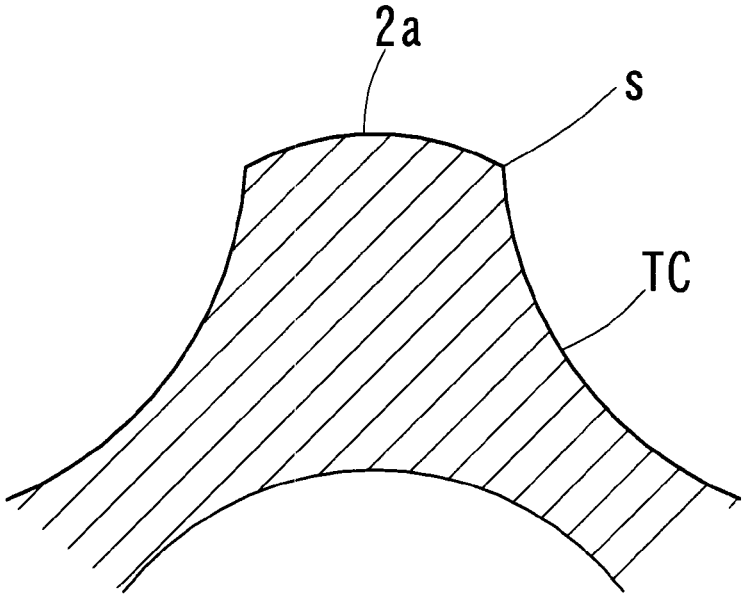

FIGS. 1 and 2 illustrate an embodiment of the present invention. In this embodiment, the tooth profile of an inner rotor 2 is formed based on the tooth-profile forming method in FIG. 8, and the tooth profile of an outer rotor 3 is formed based on the method discussed in Patent Literature 1 and Patent Literature 2. Then, the inner rotor 2 composed of an iron-based sintered alloy and having six teeth and the outer rotor 3 composed of an iron-based sintered alloy and having seven teeth are manufactured and combined with each other, whereby an internal-gear oil-pump rotor 1 is formed. The internal-gear oil-pump rotor 1 is accommodated within a rotor chamber 6 of a pump housing 5 having an intake port 7 and a discharge port 8, whereby an internal gear pump 9 is formed.

When designing the tooth profile of the inner rotor 2, the condition K<1 in the aforementioned expression (1) is satisfied, whereby loops R or cusps s are not formed at the opposite edges of each addendum 2*a* of an inner-rotor curve (tooth profile) TC, as shown in FIG. 2.

Specifically, the number n of teeth of the inner rotor is six, a rolling-circle diameter B is 5 mm (the same applies thereinafter), a base-circle diameter A is 30 (n×B), an amount e of eccentricity is 2, an outer diameter of the outer rotor is a larger diameter+6 (wall thickness of 3), a theoretical discharge rate is 3.25 $cm^3$/rev, a tip clearance t is 0.08 mm, a side clearance is 0.03 mm, a body clearance is 0.13 mm, an oil-type/oil-temperature is ATF 80° C., a discharge pressure is 0.3 MPa, a rotation speed is 3000 rpm, and a material contact fatigue strength is 600 Mpa. The material contact fatigue strength is a representative value of a sintered material, and the material is appropriately selected in accordance with the intended use of the rotor (i.e., an increase in Hertz stress due to an increase in discharge pressure).

Figure 3:
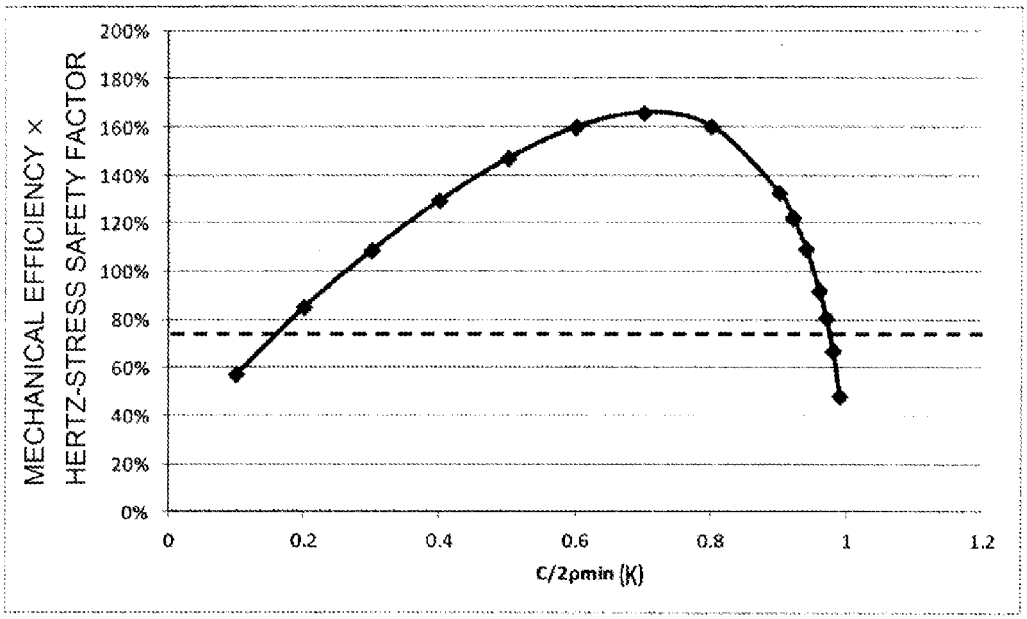
FIG. 3 illustrates the relationship between "mechanical efficiency×Hertz-stress safety factor" and K in the embodiment.
Figure 4:
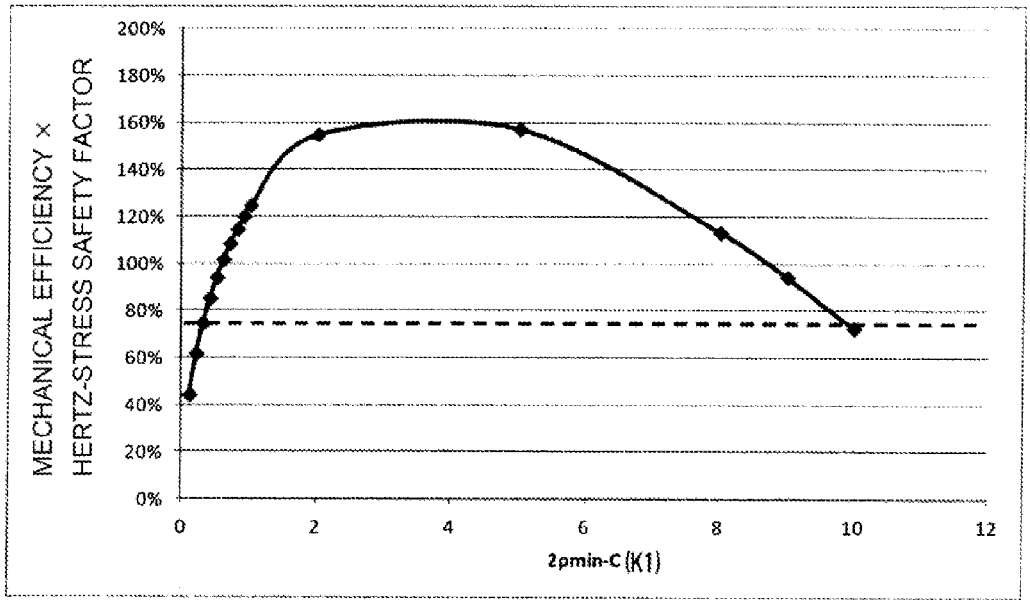
FIG. 4 illustrates the relationship between "mechanical efficiency×Hertz-stress safety factor" and K1 in the embodiment.
Figure 5:
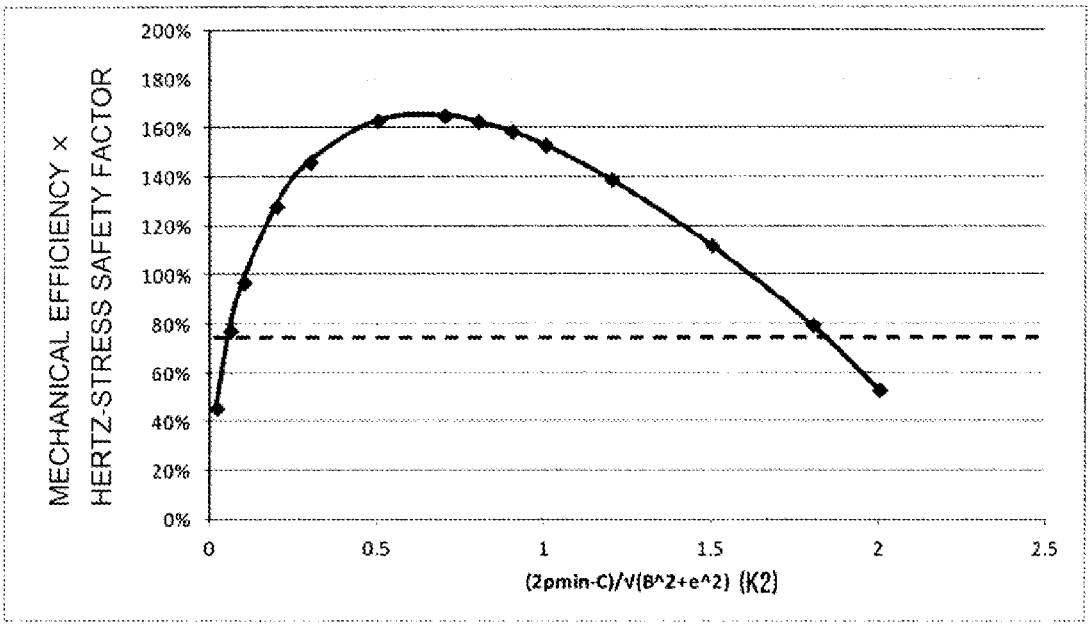
FIG. 5 illustrates the relationship between "mechanical efficiency×Hertz-stress safety factor" and K2 in the embodiment.
Figure 6:
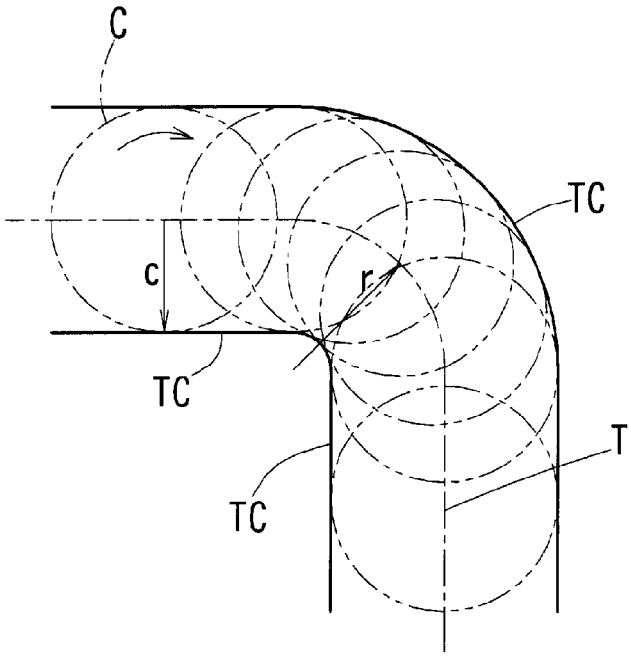
FIG. 6(*a*) illustrates an envelope of a circle C obtained when the center of the circle C moves along a locus line T, and shows a case where a diameter r of an arc section is smaller than a radius c of the circle C.
Figure 6:
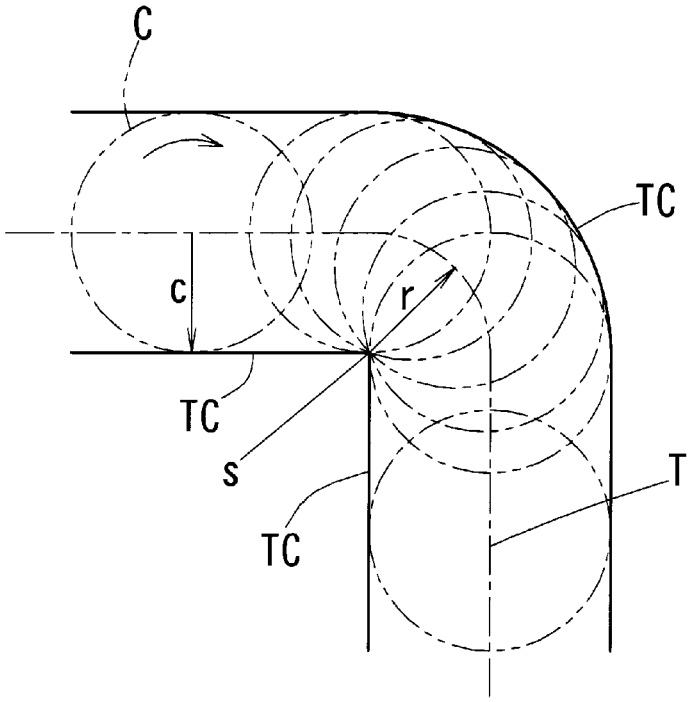
Figure 6:
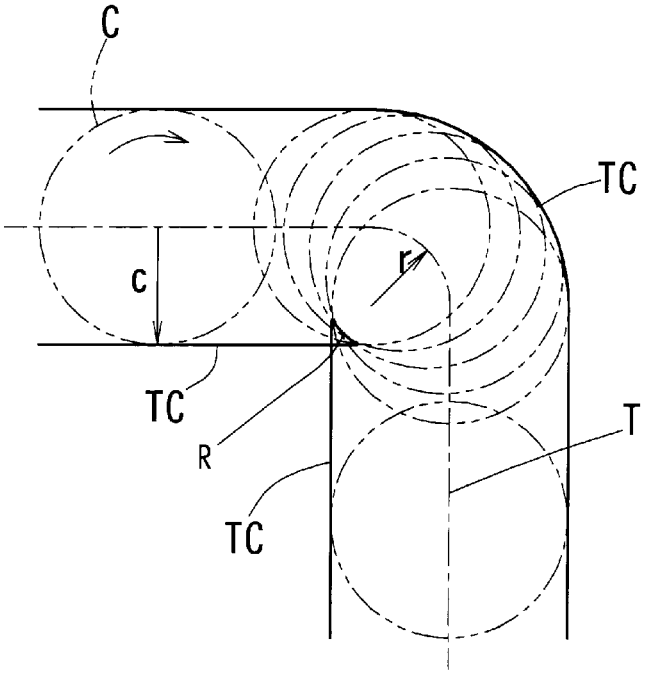
Figure 7:
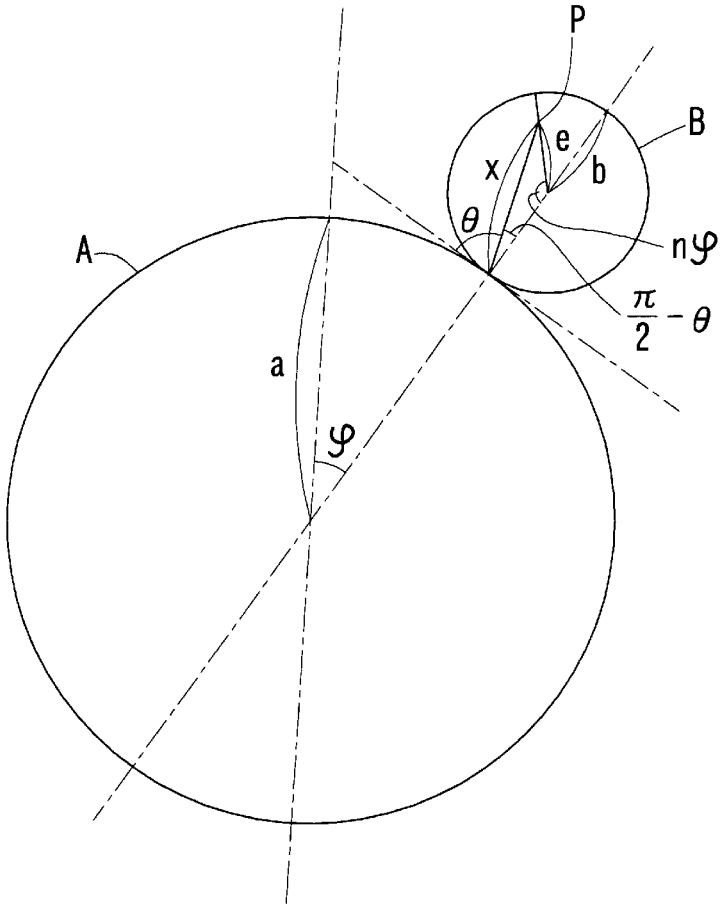
FIG. 7(*a*) illustrates how a minimum curvature radius $\rho_{min}$ of a trochoidal curve T is calculated.
Figure 7:
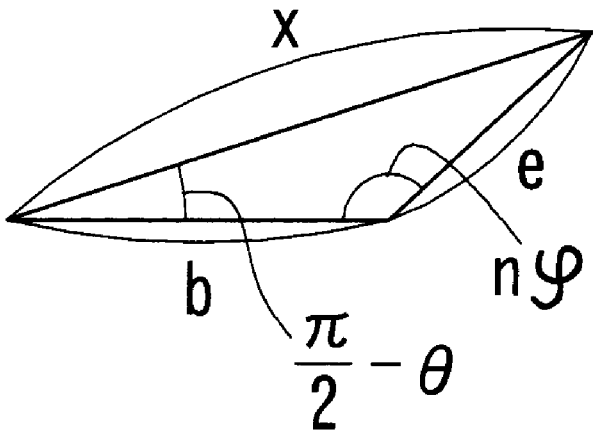

The relationship between "mechanical efficiency×Hertz-stress safety factor (simply referred to as "Hertz safety factor" or "safety factor" hereinafter)" and "$C/2\rho_{min}$ (=K)" is illustrated in FIG. 3. Table I below shows the "mechanical efficiency", the "Hertz stress", the "Hertz safety factor", and "mechanical efficiency×safety factor" with respect to each K ($C/2\rho_{min}$). Furthermore, FIG. 4 illustrates the relationship between "mechanical efficiency×Hertz-stress safety factor" and "$(2\rho_{min}-C)=K1$", and Table II below shows the "mechanical efficiency", the "Hertz stress", the "Hertz safety factor", and "mechanical efficiency×safety factor" with respect to each K1 ($2\rho_{min}-C$). Moreover, FIG. 5 illustrates the relationship between "mechanical efficiency×Hertz-stress safety factor" and the aforementioned K2. Table III below shows the "mechanical efficiency", the "Hertz stress", the "Hertz safety factor", and "mechanical efficiency×safety factor" with respect to each K2.

TABLE I

| $C/2\rho_{min}$ = K | Mechanical efficiency (%) | Hertz stress (Kgf/$mm^2$) | Hertz safety factor (%) | Mechanical efficiency × safety factor (%) |
|---|---|---|---|---|
| 0.1 | 35.3 | 372 | 161 | 57.0 |
| 0.2 | 37.6 | 266 | 226 | 84.9 |
| 0.3 | 40.0 | 221 | 271 | 108.5 |
| 0.4 | 42.5 | 197 | 304 | 129.3 |
| 0.5 | 45.0 | 184 | 326 | 146.8 |
| 0.6 | 47.7 | 179 | 335 | 159.7 |
| 0.7 | 50.4 | 182 | 329 | 165.7 |
| 0.8 | 53.2 | 199 | 301 | 160.0 |
| 0.9 | 56.0 | 253 | 237 | 132.5 |
| 0.92 | 56.5 | 277 | 216 | 122.2 |
| 0.94 | 57.1 | 314 | 191 | 109.1 |
| 0.96 | 57.7 | 377 | 159 | 91.8 |
| 0.97 | 57.9 | 431 | 139 | 80.7 |
| 0.98 | 58.2 | 523 | 115 | 66.9 |
| 0.99 | 58.5 | 732 | 82 | 48.0 |

TABLE II

| $2\rho_{min}$ − C = K1 | Mechanical efficiency (%) | Hertz stress (Kgf/$mm^2$) | Hertz safety factor (%) | Mechanical efficiency × safety factor (%) |
|---|---|---|---|---|
| 0.1 | 58.6 | 794 | 76 | 44.2 |
| 0.2 | 58.3 | 566 | 106 | 61.8 |
| 0.3 | 58.1 | 466 | 126 | 75.0 |
| 0.4 | 57.8 | 407 | 147 | 85.2 |
| 0.5 | 57.6 | 367 | 163 | 94.1 |
| 0.6 | 57.4 | 338 | 177 | 101.8 |
| 0.7 | 57.1 | 316 | 190 | 108.5 |
| 0.8 | 56.9 | 298 | 201 | 114.6 |
| 0.9 | 56.6 | 283 | 212 | 120.0 |
| 1 | 56.4 | 271 | 221 | 124.8 |
| 2 | 54.0 | 209 | 286 | 154.7 |
| 5 | 47.0 | 180 | 334 | 157.2 |
| 8 | 40.5 | 214 | 280 | 113.5 |
| 9 | 38.5 | 245 | 245 | 94.3 |
| 10 | 36.5 | 302 | 199 | 72.7 |

TABLE III

| $(2\rho min - C)/(B^2 + e^2)^{1/2}$ = K2 | Mechanical efficiency (%) | Hertz stress (Kgf/$mm^2$) | Hertz safety factor (%) | Mechanical efficiency × safety factor (%) |
|---|---|---|---|---|
| 0.02 | 58.5 | 766 | 78 | 45.9 |
| 0.06 | 58.0 | 450 | 133 | 77.3 |
| 0.1 | 57.5 | 355 | 169 | 97.2 |
| 0.2 | 56.2 | 263 | 228 | 128.3 |
| 0.3 | 54.9 | 225 | 267 | 146.4 |
| 0.5 | 52.4 | 193 | 312 | 163.2 |
| 0.7 | 50.0 | 181 | 331 | 165.3 |
| 0.8 | 48.6 | 179 | 335 | 162.8 |
| 0.9 | 47.4 | 179 | 335 | 158.7 |
| 1 | 46.2 | 181 | 332 | 153.2 |
| 1.2 | 43.8 | 189 | 317 | 139.0 |
| 1.5 | 40.4 | 216 | 278 | 112.1 |
| 1.8 | 37.1 | 280 | 214 | 79.6 |
| 2 | 35.1 | 395 | 152 | 53.2 |

In order for "mechanical efficiency×safety factor" to be higher than or equal to 75%, it is apparent from FIG. 3 and Table I that 0.2≤K≤0.97 be satisfied, from FIG. 4 and Table II that 0.3≤K1≤9.8 be satisfied, and from FIG. 5 and Table III that 0.06≤K2≤1.8 be satisfied.

Furthermore, in order to obtain a mechanical efficiency of 50% or higher and a Hertz-stress safety factor of 1.5 times (150%) or more, it is apparent from FIG. 3 and Table I that 0.7≤K≤0.96 be satisfied, from FIG. 4 and Table II that 0.5≤K1≤2 be satisfied, and from FIG. 5 and Table III that 0.1≤K2≤0.7 be satisfied.

The tooth profile of the outer rotor 3 is not limited to an envelope of a group of tooth-profile curves formed by revolution and rotation of the inner rotor 2 described above. Alternatively, the tooth profile of the outer rotor 3 may be obtained based on any method so long as the envelope is, for example, the minimal tooth-profile line of the outer rotor 3 for allowing rotation without causing the inner rotor 2 and the outer rotor 3 to interfere with each other, and the tooth profile is drawn at the outer side of the envelope.

Furthermore, the number of teeth in the inner rotor 2 is not limited to six, and may be a freely-chosen number.

Accordingly, the disclosed embodiment is merely an example in all aspects and should not be limitative. The scope of the invention is defined by the claims and is intended to encompass interpretations equivalent to the scope of the claims and to include all modifications within the scope.

REFERENCE SIGNS LIST

1 internal-gear oil-pump rotor
2 inner rotor
2*a* addendum of inner rotor
3 outer rotor
4 pump chamber
5 pump housing
6 rotor chamber
7 intake port
8 discharge port
9 internal gear pump
A base-circle diameter
B rolling-circle diameter
C locus-circle diameter
T trochoidal curve
TC tooth profile (inner-rotor curve)

The invention claimed is:

1. An internal gear pump wherein a diameter of a base circle is set to A mm, a diameter of a rolling circle is set to B mm, a radius of the rolling circle is set to b mm, a diameter of a locus circle is set to C mm, and an amount of eccentricity is set to e mm, wherein a trochoidal curve (T) is drawn by rolling the rolling circle along the base circle without slipping and by using a locus of a fixed point distant from a center of the rolling circle by e, wherein a tooth profile of an inner rotor having n teeth is formed based on an envelope of a group of the locus circles each having a center on the trochoidal curve (T), wherein a pump rotor is formed by combining the inner rotor with an outer rotor having (n+1) teeth, and wherein a tooth-profile curve of the inner rotor satisfies expression (1):

$$K = \frac{C}{6} \cdot \frac{n+2}{n+1} \cdot \sqrt{\frac{n+2}{3n(b^2-e^2)}} < 1, \tag{1}$$

and wherein when a minimum curvature radius $\rho_{min}$ of the trochoidal curve (T) is defined by expression (2) and K1=(2$\rho_{min}$−C), 0.5≤K1≤2 is satisfied:

$$\rho_{min} = 3 \cdot \frac{n+1}{n+2} \cdot \sqrt{\frac{3n(b^2-e^2)}{n+2}}. \tag{2}$$

2. The internal gear pump according to claim 1, wherein 0.7≤K≤0.96 is satisfied.

3. The internal gear pump according to claim 1, wherein when K2 is defined by expression (3), 0.06≤K2≤1.8 is satisfied:

$$K2 = \frac{K1}{\sqrt{B^2+e^2}} (B = A/n). \tag{3}$$

4. The internal gear pump according to claim 3, wherein 0.1≤K2≤0.7 is satisfied.

5. A method for forming a tooth profile of an inner rotor of an internal gear pump, comprising:

setting a diameter of a base circle to A mm, a diameter of a rolling circle to B mm, a radius of the rolling circle to b mm, a diameter of a locus circle to C mm, and an amount of eccentricity to e mm;

drawing a trochoidal curve (T) by rolling the rolling circle along the base circle without slipping and by using a locus of a fixed point distant from a center of the rolling circle by e;

forming a tooth profile of an inner rotor having n teeth based on an envelope of a group of the locus circles each having a center on the trochoidal curve (T); and forming a pump rotor by combining the inner rotor with an outer rotor having (n+1) teeth, wherein a tooth-profile curve of the inner rotor satisfies expression (1):

$$K = \frac{C}{6} \cdot \frac{n+2}{n+1} \cdot \sqrt{\frac{n+2}{3n(b^2-e^2)}} < 1, \tag{1}$$

and wherein when a minimum curvature radius $\rho_{min}$ of the trochoidal curve (T) is defined by expression (2) and K1=(2$\rho_{min}$−C), 0.5≤K1≤2 is satisfied:

$$\rho_{min} = 3 \cdot \frac{n+1}{n+2} \cdot \sqrt{\frac{3n(b^2-e^2)}{n+2}}. \tag{2}$$

6. The method for forming a tooth profile of an inner rotor of an internal gear pump according to claim 5, wherein 0.7≤K≤0.96 is satisfied.

7. The method for forming a tooth profile of an inner rotor of an internal gear pump according to claim 5, wherein when K2 is defined by expression (3), 0.06≤K2≤1.8 is satisfied:

$$K2 = \frac{K1}{\sqrt{B^2+e^2}} (B = A/n). \tag{3}$$

8. The method for forming a tooth profile of an inner rotor of an internal gear pump according to claim 7, wherein 0.1≤K2≤0.7 is satisfied.

* * * * *